US009593836B2

(12) United States Patent
Willeke

(10) Patent No.: US 9,593,836 B2
(45) Date of Patent: Mar. 14, 2017

(54) DEVICE FOR FASTENING A FAN

(71) Applicant: Hella KGaA Hueck & Co., Lippstadt (DE)

(72) Inventor: Franz-Georg Willeke, Anröchte (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 683 days.

(21) Appl. No.: 14/088,171

(22) Filed: Nov. 22, 2013

(65) Prior Publication Data

US 2014/0186178 A1 Jul. 3, 2014

(30) Foreign Application Priority Data

Nov. 30, 2012 (DE) ..... 10 2012 111 640

(51) Int. Cl.
*F21S 8/10* (2006.01)
*F21V 29/02* (2006.01)
*F21Y 101/00* (2016.01)

(52) U.S. Cl.
CPC ..... *F21V 29/02* (2013.01); *F21S 48/321* (2013.01); *F21S 48/325* (2013.01); *F21Y 2101/00* (2013.01)

(58) Field of Classification Search
CPC .... F21V 33/0096; F21V 29/02; F21S 48/325; F21S 48/321; F21Y 2101/00; F04D 29/60; F04D 29/62; F04D 29/54
See application file for complete search history.

(56) References Cited

U.S. PATENT DOCUMENTS

| | | | | |
|---|---|---|---|---|
| 6,351,380 | B1 | 2/2002 | Curlee et al. | |
| 6,894,897 | B1 | 5/2005 | Nagurny et al. | |
| 2009/0195159 | A1 | 8/2009 | Smith | |
| 2011/0128752 | A1* | 6/2011 | Herbers | F21S 48/325 362/545 |

FOREIGN PATENT DOCUMENTS

| | | | |
|---|---|---|---|
| DE | 202005005939 | U1 | 6/2005 |
| EP | 1617085 | A1 | 1/2006 |
| EP | 2327928 | A1 | 6/2011 |

* cited by examiner

*Primary Examiner* — Richard Edgar
(74) *Attorney, Agent, or Firm* — Husch Blackwell LLP

(57) ABSTRACT

A device for fastening a fan in a housing of a lighting device, wherein the lighting device has a pot-shaped housing in which a number of lighting units are arranged, such that the fan can be fastened on a carrier frame at several fastening points by means of fasteners, wherein the carrier frame can be fastened on the housing by means of additional fasteners, wherein the fan is connected to the carrier frame at each fastening point by a plug-in connection as a fastener.

9 Claims, 1 Drawing Sheet

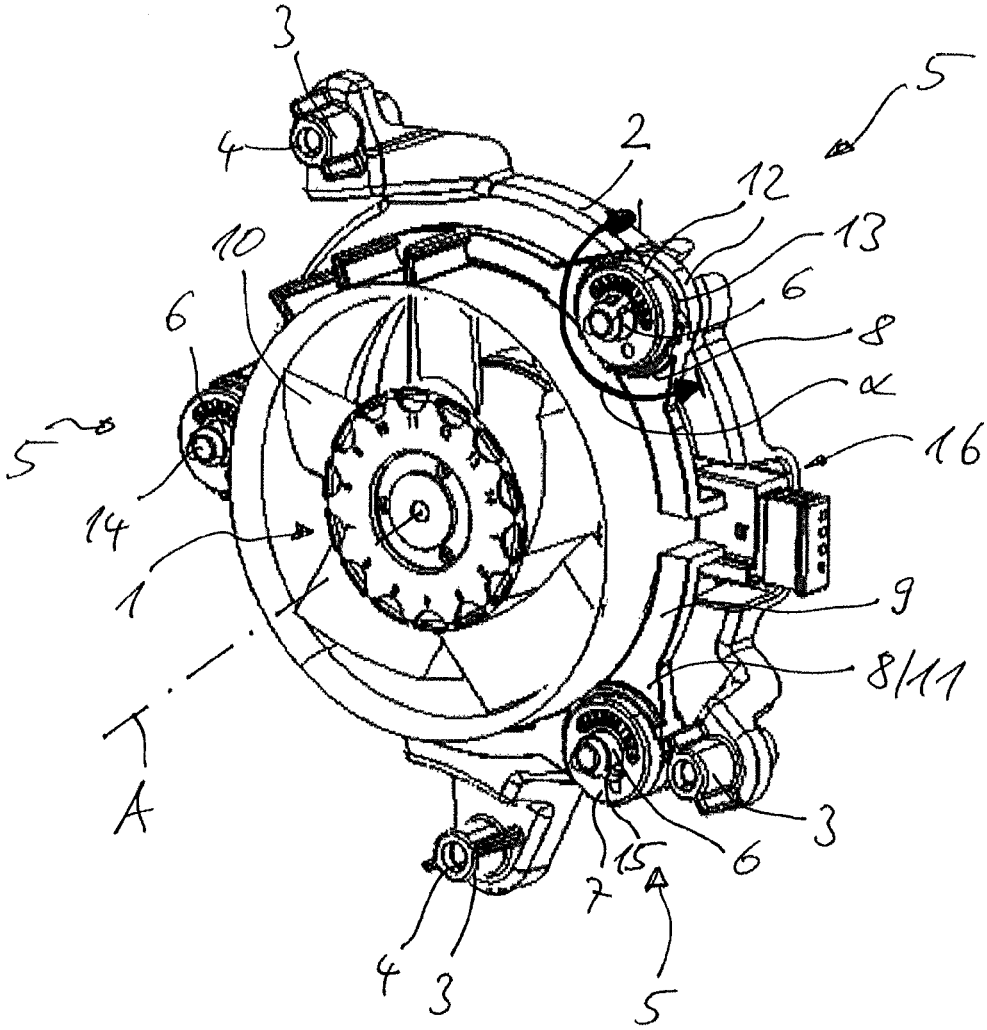
3
4
2
5
12
13
10
6
8
6
α
5
16
14
1
9
8/11
A
3
6
15
7
4
3
5

DEVICE FOR FASTENING A FAN

CROSS REFERENCE

This application claims priority to German Patent Application No. 10 2012 111640.7, filed Nov. 30, 2012.

TECHNICAL FIELD OF THE INVENTION

The invention relates to a device for fastening a fan in a housing of a lighting device, wherein the lighting device has a pot-shaped housing in which a number of light units are arranged such that the fan can be fastened on a retaining part at several fastening points by means of fasteners.

BACKGROUND OF THE INVENTION

From EP 2 327 928 A1, a device for fastening a fan in a housing of a fastening device is known, wherein the fan can be fastened on a carrier frame accordingly by threaded connections. The carrier frame can be connected by means of additional fasteners, in particular, by threaded connections, to a pot-shaped housing of the lighting device. The threaded connection between the fan and the carrier frame requires that fastening bolts must be used as fasteners at each of the fastening points distributed in the peripheral direction.

The problem of the present invention is to refine a device for fastening a fan in a housing of a lighting device such that the assembly complexity can be reduced in a simple way.

SUMMARY OF THE INVENTION

To solve this problem, the fan is connected to the carrier frame at each fastening point by a plug-in connection as a fastener.

According to the invention, the fastening of the fan on a carrier frame is carried out by means of a plug-in connection. Advantageously, two fasteners adapted to each other are connected to each other at the fastening points through a linear plug-in motion, so that a secure mounting is realized. In this way the installation complexity can be significantly reduced.

According to one preferred embodiment of the invention, the plug-in connection is formed, on one hand, by a fastening pin and, on the other hand, by a flexible fastening socket, wherein the fastening pin can be inserted partially through the fastening socket. The fastening socket has a central opening whose edge advantageously has a smaller diameter than the fastening pin. In this way, a clamping mounting of the fan on the retaining part is guaranteed. In addition, the flexible fastening socket enables an improved acoustic insulation factor between the fan and the retaining part. Due to the flexibility of the fastening socket, undesired vibrations of the fan can be better absorbed.

According to one refinement of the invention, the fan has, on the edges, an edge recess at each of the fastening points. A fastening socket can be set on each of these recesses. Through a subsequent insertion of the fastening pin through the fastening socket, a secure and durable mounting of the fan on the retaining part can be realized.

According to one refinement of the invention, the fastening socket has two coaxial washer rings that are arranged at a distance to each other and between which an annular groove is formed in which the advantageously C-shaped edge recess of the fan edge engages with a clamping effect. Advantageously, the fastening sockets can thus be mounted on the fan in a simple way.

According to one refinement of the invention, the edge recess of the fan extends along an obtuse peripheral angle, so that approximately a "peripheral gripping" of the fastening socket can be realized. In this way, an especially secure mounting of the fastening sockets on the fan is guaranteed.

According to one refinement of the invention, the fastening pin of the mounting part has, on one free end area, a laterally projecting retaining cam, so that, in the installed state, the axial position of the fastening socket relative to the fastening pin is guaranteed, even if the fastening pin does not engage with a clamping effect in the fastening socket.

According to one refinement of the invention, the fastening socket consists of an elastic material, in particular, a rubber material. The fastening socket is advantageously constructed in one piece. In addition to the fastening function, the fastening socket also makes acoustic insulation possible.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

FIG. 1 is a perspective front view of an arrangement consisting of a carrier frame and a fan in the assembled state.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the FIGURES. In other instances, well-known methods, procedures, and components have not been described in detail so as not to obscure the present invention.

A fastening device according to the invention is advantageously used for fastening the fans 1 in a housing of a lighting device for motor vehicles. Such a lighting device can be constructed, for example, as headlamps in which a number of light units are integrated. As the light source, the light units can have an LED light source that is cooled by means of the fan 1.

An embodiment of the invention shown in the FIGURE shows the fan 1 that is not fastened directly on the housing of the lighting device, but instead is fastened on the housing of the lighting device by means of a carrier frame 2. The carrier frame 2 forms a retaining part on which the fan 1 is mounted. Alternatively, the retaining part could also be molded on the housing or formed by the housing itself. The carrier frame 2 has radially projecting necks 3 that are formed such that the carrier frame 2 is fastened on an inner wall of the lighting device by means of a threaded connection or on a frame of this device. Each neck 3 has a passage hole 4 in which not shown fastening bolts can be inserted.

The fastening of the fan 1 on the carrier frame 2 is carried out by means of a plug-in connection. As the fasteners, the carrier frame 2 has a fastening pin 6 that is parallel to an axis A of the fan 1 at each corresponding fastening point 5. As the fasteners, the fan 1 has a fastening socket 7 that is mounted on an edge recess 8 of the fan 1 at each of the fastening points 5.

The edge recess 8 of the fan 1 extends on the outside of a retaining ring 9 of the fan 1, wherein the retaining ring 9 is coaxial to and surrounds a blade wheel 10 of the fan 1.

The edge recess 8 has a C-shaped edge that connects to parallel flat sides 11 of the retaining ring 9. The flat sides are perpendicular to the rotational axis of the fan 1.

The flexible fastening socket 7 consists of an elastic material, advantageously a rubber material. The fastening socket 7 is advantageously constructed in one piece. The fastening socket 7 has two washer rings 12 that are spaced apart from each other and between which there is an annular groove 13. The washer rings 12 and the annular groove 13 define a passage opening of the fastening socket 7 whose diameter is smaller than an outer diameter of the fastening pin 6. By inserting or partially engaging the fastening pin 6 in the opening of the fastening socket 7, a clamping plug-in connection can be realized.

Advantageously, for the installation, in a first step the fastening sockets 7 are connected with a clamping effect to the retaining ring 9 of the fan 1 at the fastening points 5. For the secure mounting, the C-shaped edge recess 8 extends at an obtuse angle α. A thickness of the C-shaped edge of the edge recess 8 is greater than a width of the annular groove 13, so that by setting the fastening sockets 7 on each edge recess 8, a secure mounting of the fastening socket 9 on the retaining ring 9 of the fan 1 is guaranteed.

In a second installation step, the axial fastening pins 6 of the carrier frame 2 are inserted through the corresponding passage openings of the fastening socket 7 until a free end area 14 of the fastening pin 6 is inserted through the fastening socket 7. In the free end area 14, a laterally projecting retaining cam 15 is molded that engages behind a washer ring 12 of the fastening socket 7 and is used for the axial securing of the fastening pin 6 relative to the fastening socket 7. Alternatively, the retaining cam 15 could also be left out, because the fastening socket 7 is held by the friction force on the fastening pin 6.

According to one not-shown alternative embodiment of the invention, the inner diameter of the fastening socket 7 could also be equal to the outer diameter of the fastening pin 6. Thus no or only minimal friction forces act on the inner wall of the fastening socket 7. By positioning the retaining cam 15 in the axial direction, the relative axial position of the fastening socket 7 to the fastening pin 6 is ensured.

According to another not-shown alternative embodiment, the fastening pin 6 can have, instead of a linear form, also a hook-shaped form, wherein a first leg projects in the radial direction into the carrier frame 2 and wherein a connecting second leg can engage extending into the fastening socket 7 in the axial direction.

Advantageously, the carrier frame 2 has several axial recesses 16, so that the fan 1 can be brought into a radially secured insertion position relative to the carrier frame 2, after which the installation of the fan 1 described above on the carrier frame 2 can be carried out.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

LIST OF REFERENCE SYMBOLS

1 Fan
2 Carrier frame
3 Necks
4 Passage holes
5 Fastening points
6 Fastening pin
7 Fastening socket
8 Edge recess
9 Retaining ring
10 Blade wheel
11 Flat side
12 Washer rings
13 Annular groove
14 Free end area
15 Retaining cam
16 Axial recesses
A Shaft
α Peripheral angle

The invention claimed is:

1. A device for fastening a fan within a lighting device, comprising:

a pot-shaped housing of said lighting device in which a number of lighting units are arranged, a retaining part of the housing on which the fan can be fastened at several fastening points by means of fasteners, wherein the fan is connected to the retaining part at each fastening point by a plug-in connection, and wherein the plug-in connection has a fastening pin and a flexible fastening socket, wherein the fastening pin can be inserted into the flexible fastening socket.

2. The device according to claim 1, wherein the flexible fastening socket is set on an edge recess of the fan with a clamping effect.

3. The device according to claim 2, wherein the flexible fastening socket has an annular groove that connects coaxial washer rings in the axial direction and that, in the installed position, the edge recess of the fan is inserted into the annular groove, wherein each washer ring contacts a flat side of the edge recess.

4. The device according to claim 2, wherein the edge recess of the fan extends in an obtuse peripheral angle.

5. The device according to claim 2, wherein the edge recess of the fan has a C-shaped edge, wherein a thickness of the C-shaped edge is greater than a width of the annular groove.

6. The device according to claim 1, wherein, in a free end area of the fastening pin, a retaining cam projects laterally for engaging behind the flexible fastening socket set on the fastening pin.

7. The device according to claim 1, wherein the flexible fastening socket is made from an elastic material.

8. The device according to claim 1, wherein the retaining part is constructed as a carrier frame, wherein the carrier frame can be fastened on the housing by means of additional fasteners.

9. The device according to claim 1, wherein the light unit has an LED light source that is allocated spatially to the fan.

* * * * *